United States Patent [19]

Cross

[11] 4,423,536

[45] Jan. 3, 1984

[54] TORQUE CANCELLING, TORQUE TYPE WINDOW SASH BALANCE

[76] Inventor: Rex D. Cross, 375 Fairfield Ave., Stamford, Conn. 06905

[21] Appl. No.: 255,750

[22] Filed: Apr. 20, 1981

[51] Int. Cl.[3] ..... E05D 13/12

[52] U.S. Cl. ..... 16/197; 16/DIG. 36; 49/445

[58] Field of Search ..... 16/197, 198, 199, 200, 16/201, DIG. 36; 49/181, 445, 446

[56] References Cited

U.S. PATENT DOCUMENTS

| | | | |
|---|---|---|---|
| 1,771,997 | 8/1930 | Fast . | |
| 1,864,745 | 6/1932 | Larson . | |
| 2,041,646 | 5/1936 | Larson | 16/197 |
| 2,122,576 | 7/1938 | Larson | 16/197 |
| 2,577,953 | 12/1951 | De Vires et al. | 16/197 |
| 2,635,282 | 4/1953 | Trammell, Sr. et al. | 16/197 |
| 3,220,064 | 11/1965 | Nobes | 16/197 X |
| 3,521,320 | 7/1970 | Perry | 16/197 |

*Primary Examiner*—Fred Silverberg

*Attorney, Agent, or Firm*—F. Eugene Davis, IV

[57] ABSTRACT

A pair of oppositely wound torsion springs and a pair of oppositely wound spiral ribbon actuators therefor are provided in a unitary construction as a window sash balance. There are torques developed between each of the spiral ribbon actuators and its respective spring. The two torques are in opposite directions and cancel each other. This eliminates torque which would otherwise, when applied to the window sash, increase the friction between the sash and the window jam and make difficult the operation of tilt type and removable sashes.

10 Claims, 7 Drawing Figures

TORQUE CANCELLING, TORQUE TYPE WINDOW SASH BALANCE

TECHNICAL FIELD

This application relates to window sash balances. More particularly it relates to torsion spring balances.

BACKGROUND ART

Existing torsion spring sash balances produce a torque between the spirally wound torsion spring and the actuator therefor. This torque is communicated to the window sash and greatly increases the friction between the window sash and the jam.

Torsion spring window sash balances are also employed with double-hung windows that may be tilted into the room for cleaning. Upon tilting, the resultant torque between the sash balance spring and actuator may cause the window to jam or make it impossible for an untrained person to replace the window in the window unit if it has been removed. Torsion spring window sash balances are well-known in the art as exemplified by U.S. Pat. No. 1,771,997 issued to A. C. Fast, Aug. 5, 1930; U.S. Pat. No. 1,864,745 issued to A. Larson, June 28, 1932; U.S. Pat. No. 2,041,646 issued to A. Larson, May 19, 1936; and U.S. Pat. No. 2,122,576 issued to A. Larson, July 5, 1938. None of these recognize the torque problem nor disclose or suggest any way of eliminating it.

DISCLOSURE OF THE INVENTION

As illustrated in FIG. 1, in order to eliminate torque on the window sash, I provide two oppositely wound torsion spring sash balances generally indicated at 20 and 22. The two sash balances 20 and 22 are both connected to a sash attachment 24, which is connected to the sash (not shown) and by pin 26 to the jam. The actuators 28 and 30 are also oppositely wound. Thus, the torque produced between pin 26 and sash attachment 24 by sash balance 20 is equal and opposite to that produced between pin 26 and sash attachment 24 by sash balance 22.

OBJECTS OF THE INVENTION

It is therefore an object of the invention to provide a window sash balance.

Another object of the invention is to provide a window sash balance of the torsion spring type.

A further object of the invention is to provide such a window sash balance producing little or no torque between the window sash and jam.

Still another object of the invention is to provide such a window sash balance that may be made on existing window sash balance manufacturing machines.

Yet still another object of the invention is to provide such window sash balances which are inexpensive to manufacture and may be installed by conventional means.

Other objects of the invention will in part be obvious and will in part appear hereinafter.

The invention accordingly comprises the features of construction, combination of elements, arrangements of parts and articles of manufacture possessing the features, properties and relationship of elements which will be exemplified in the constructions and articles hereinafter described.

The scope of the invention is indicated in the Claims.

BRIEF DESCRIPTION OF THE DRAWINGS

For a fuller understanding of the nature and objects of the invention, reference should be had to the following detailed description taken in connection with the accompanying drawings in which.

The same reference characters refer to the same elements throughout the several views of the drawings.

BEST MODE FOR CARRYING OUT THE INVENTION

Figures 1, 2, 3:
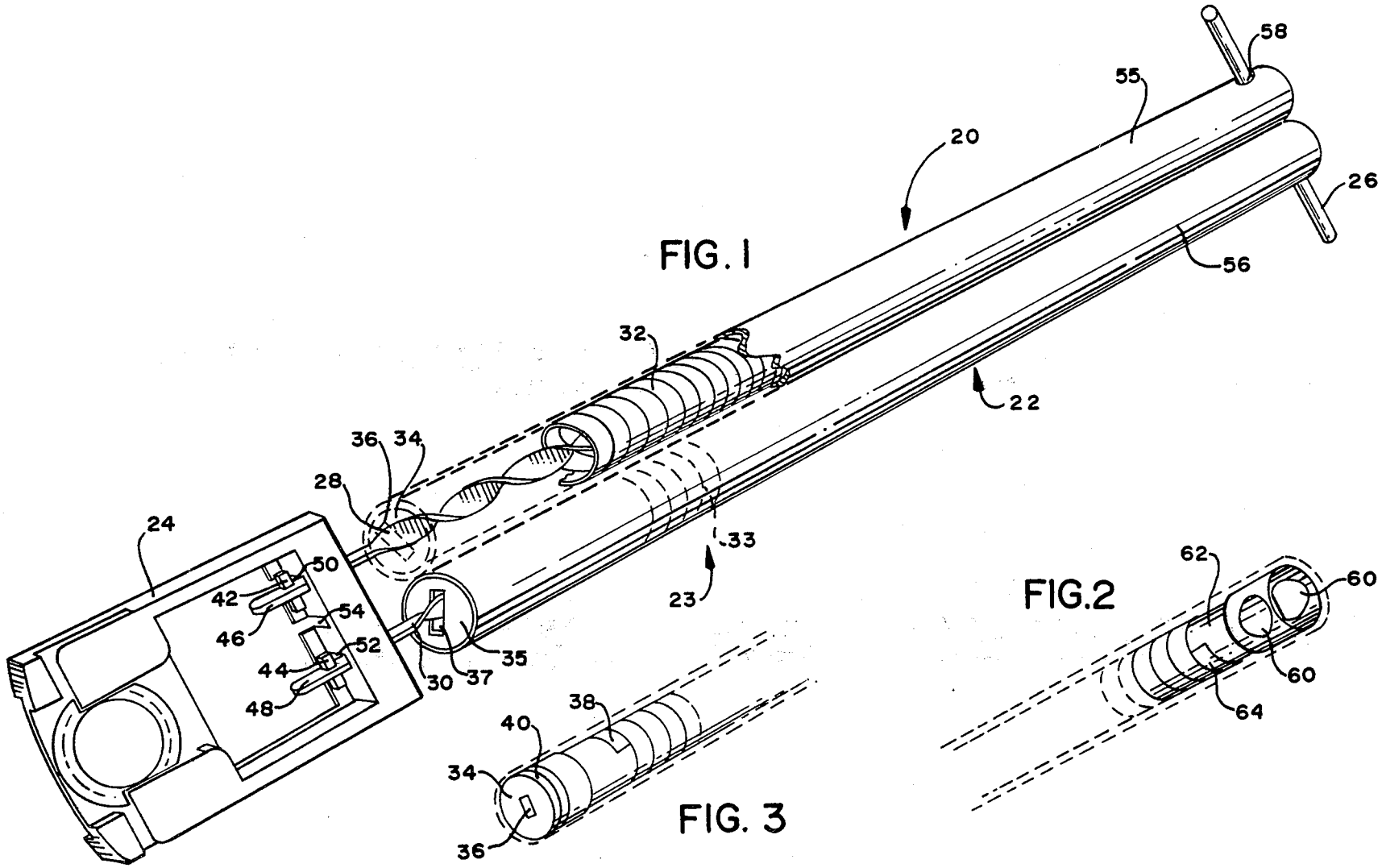
FIG. 1 is a perspective view, partially cut away, of a torque-free window sash balance according to my invention.
FIG. 2 is a perspective view, partially in phantom, of one of the pawls of the sash balance of FIG. 1.
FIG. 3 is a perspective view, partially in phantom, of one of the spring attachment means of the sash balance of FIG. 1.

Again referring to FIG. 1, each of the individual sash balances 20 and 22 shown in FIG. 1 is a conventional torsion spring sash balance according to the prior art. The only difference between them is that the torsion spring 32 of balance 20 is wound oppositely to the torsion spring of balance 22. Similarly, spiral ribbon actuator 28 is wound oppositely to spiral ribbon actuator 30. Thus, when my torque free sash balance 23 is elongated by pulling the sash attachment 24 away from the jam attachment pin 26, the springs wind up in opposite directions and produce equal and opposite torques between the pin 26 and the sash attachment 24 and thus between the sash and the jam.

The springs and spiral ribbon actuators are mirror images of each other and thus produce the same torque but in opposite directions and the two torques cancel.

As is well known in the art, the spiral ribbon actuators 28 and 30 when pulled rotate pawls 34 and 35 having rectangular slits 36 and 37 and having the ends 38 and 39 of the springs frictionally engaged therewith. The pawls 36 and 38 may be provided with a loose washer 40 as is known in the art.

Again referring to FIG. 1, the spiral ribbons 28 and 30 are attached to the sash attachment 24 in the conventional manner by means of cross pieces 42 and 44 or alternatively they may be attached directly to the sash by means of nail or screw holes 46, 48. The sash attachment means 24 is provided with an additional pair of slots 50 and 52 on either side of the single slot 54 provided by the prior art.

The two housings or tubes 55 and 56 may be attached together by means of a common eyelet 58 which in sash balance 20 and 22 passes through holes 60 in a conventional spring attachment means 62 through which the spring end 64 is attached frictionally as in the prior art.

Figure 4:
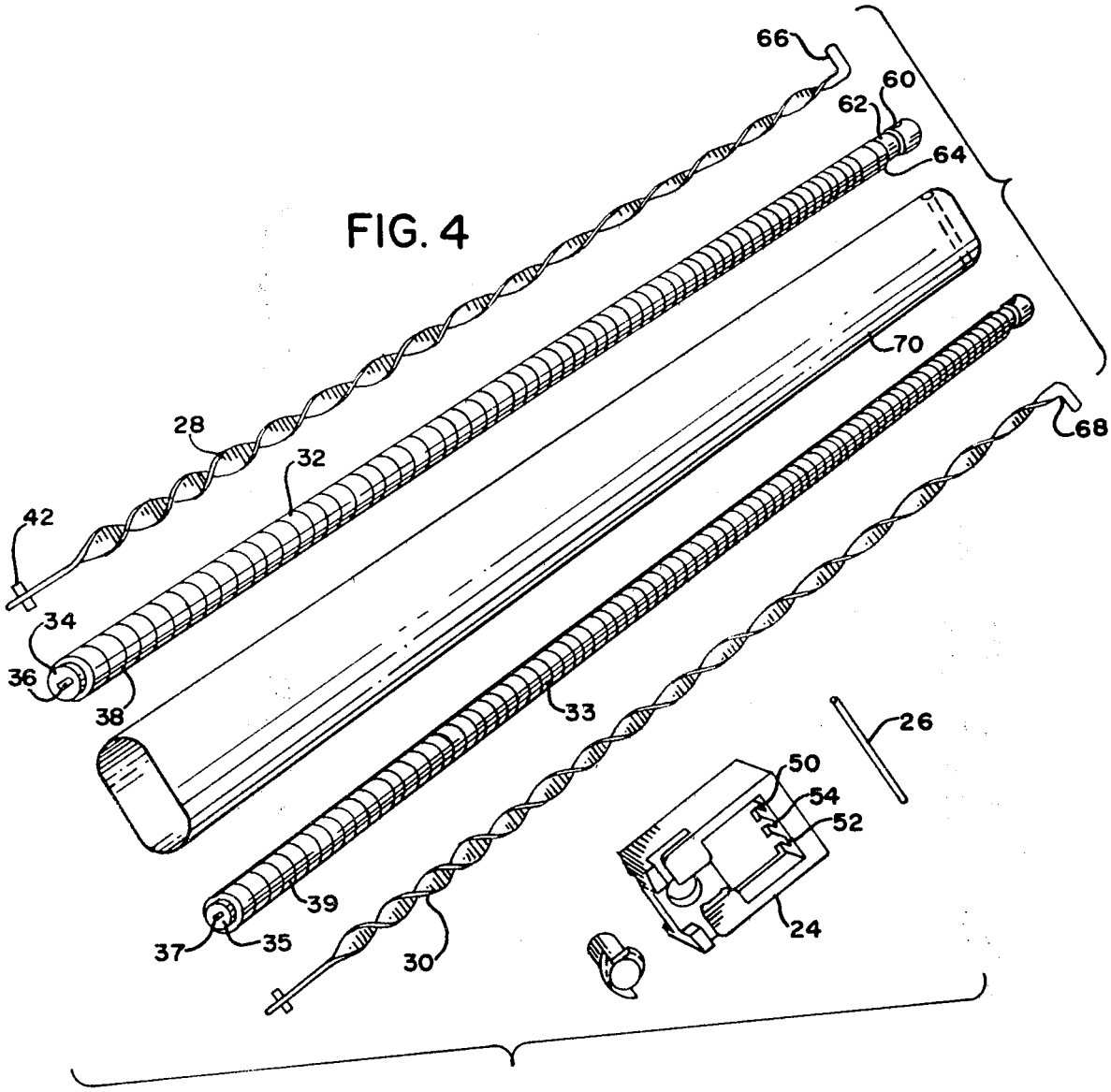
FIG. 4 is an exploded view of the sash balance of FIG. 1.

Referring to FIG. 4, the spiral ribbons 28 and 30 may be provided with bent ends 66 and 68 to prevent their being pulled from out of the pawls 34 and 35.

In the modification illustrated in FIG. 4 a single oval tube 70 is provided for housing springs 32 and 33.

Spring 32 is wound clockwise and spiral ribbon 28 is wound counter-clockwise while spring 33 is wound counter-clockwise and spiral ribbon 30 is wound clockwise to produce the torque canceling effect of the invention.

Figure 5:
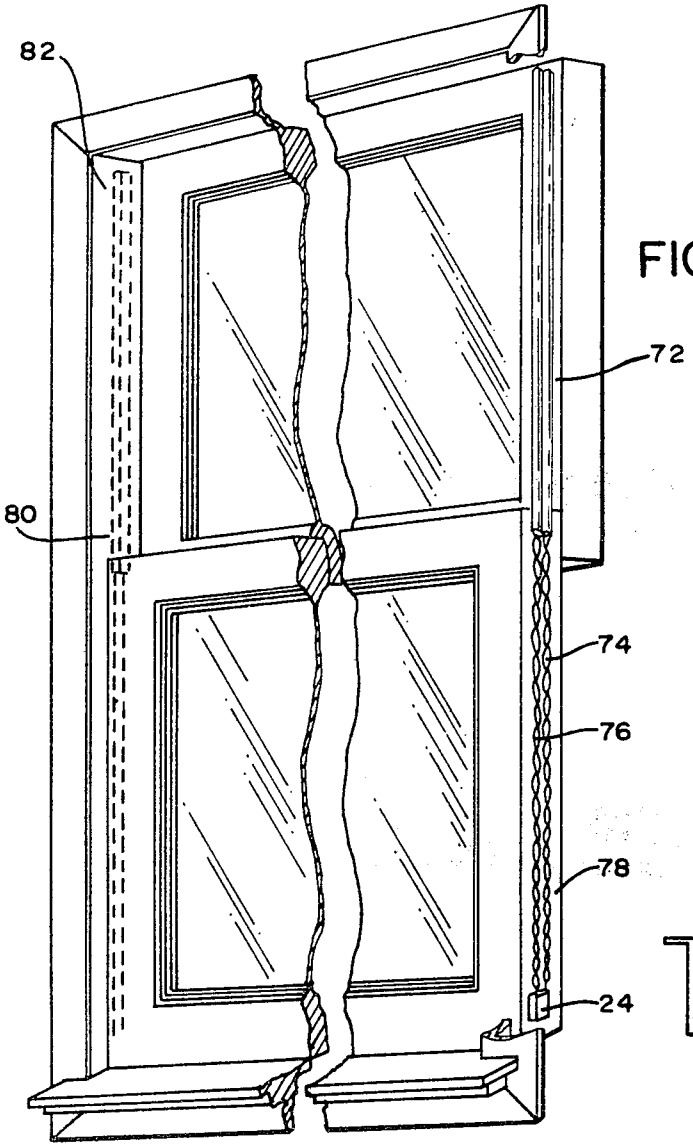
FIG. 5 is a perspective view of the sash balance of FIG. 1 installed in a sash.

FIG. 5 illustrates how either a two spring unitary sash balance or two sash balances constructed according to the prior art generally indicated at 72 and having oppositely wound spiral actuators 74 and 76 and corresponding oppositely wound springs may be attached to a lower sash 78. If more spring balance is necessary, another pair 80 may be attached on the opposite side between the jam 82 and the sash 78.

Figure 6:
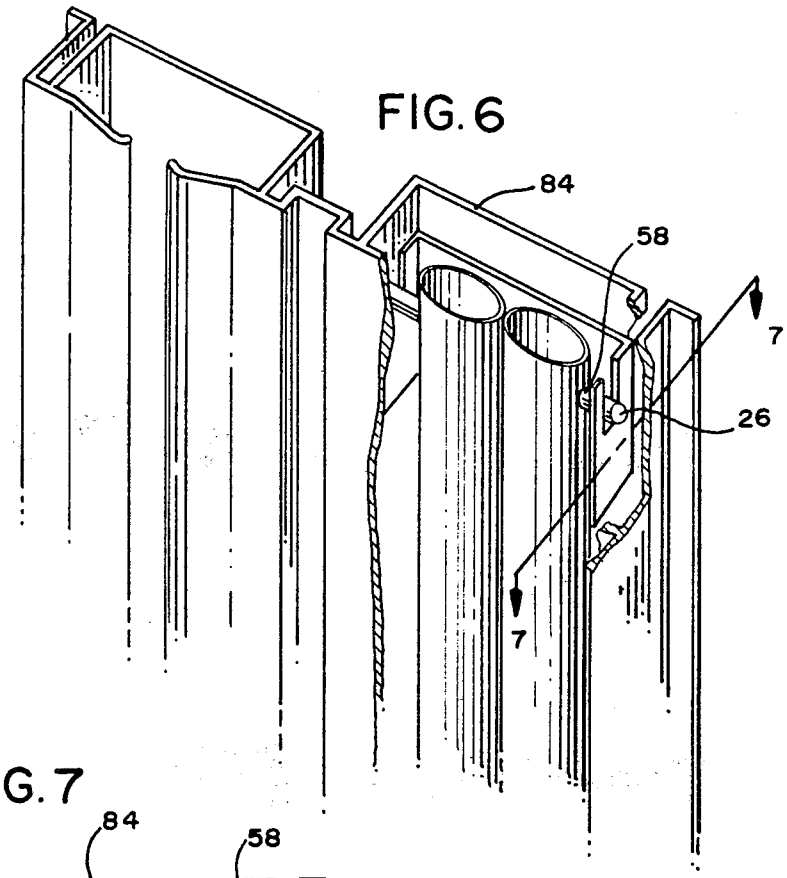
FIG. 6 is a perspective view partially cut away of the installed sash balance of FIG. 5.

FIG. 6 illustrates how the pin 26 through eyelet 58 may be mounted in a window sash guide 84 of the prior art in the same way single spring sash balances are mounted. Alternatively a nail or screw passing through eyelet 58 may directly engage the jam.

Figure 7:
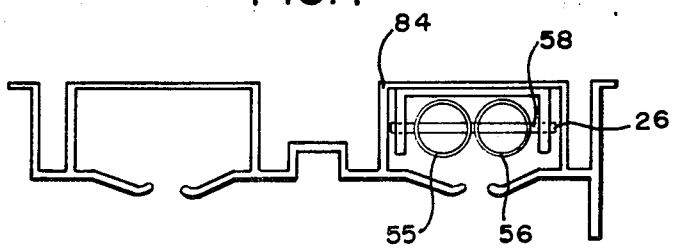
FIG. 7 is a cross sectional view taken along line 7—7 of FIG. 6.

FIG. 7 is a top view of the mounting illustrated in FIG. 6. It also illustrates how the eyelet 58 holds the two tubes 55 and 56 together.

It will thus be seen that the objects set forth above among those made apparent from the preceeding description are efficiently attained and, since certain changes may be made in the above constructions and articles without departing from the scope of the invention, it is intended that all matter contained in the above description as shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A window sash balance comprising a pair of oppositely wound helical springs, means for attaching said springs to a jam, a pair of oppositely wound actuators, each of said actuators being oppositely wound with respect to an associated one of said springs for winding said springs in opposite directions when the balance is elongated and means for attaching said actuators to a sash, the resultant torques produced by the springs on the actuators being equal and opposite and substantially cancelling each other when the balance is elongated.

2. A window sash balance as defined in claim 1 wherein said actuators are oppositely wound helical ribbons.

3. A window sash balance as defined in claims 1 or 2 wherein each of said springs is mounted in a separate tube.

4. A window sash balance as defined in claim 3 wherein said springs are kept from rotating at one end by unitary means.

5. A window sash balance as defined in claims 1 or 2 wherein both of said springs are mounted in a single tube.

6. A window sash balance as defined in claim 5 wherein said single tube is eliptical in cross section.

7. A window sash balance as defined in claim 1 or 2 wherein said oppositely wound springs are kept from rotating at one end by unitary means.

8. A window sash balance as defined in claims 1 or 2 and sash attachment means for retaining the outer ends of said actuators and preventing rotation thereof.

9. A window sash balance mechanism installed in a window characterized by a pair of torsion spring window balances each connected between the jam and the sash of the window and having oppositely wound helical springs attached to the jam and a pair of oppositely wound helical actuators attached to the sash, each of said actuators being oppositely wound with respect to an associated one of said springs, and winding said springs in opposite directions when the balance is elongated, the resultant torques produced by the springs on the actuators when the actuators are attached to a sash substantially cancelling each other.

10. A window sash balance as defined in claim 9 wherein said actuators are oppositely wound helical ribbons.

* * * * *